United States Patent [19]

Delaney

[11] Patent Number: 4,934,703

[45] Date of Patent: Jun. 19, 1990

[54] DURABLE WOODEN GOLF CLUB HEAD

[75] Inventor: Howard C. Delaney, Erlanger, Ky.

[73] Assignee: Cincinnati Golf Service, Inc., Cincinnati, Ohio

[21] Appl. No.: 285,539

[22] Filed: Dec. 16, 1988

[51] Int. Cl.[5] ..... A63B 53/04

[52] U.S. Cl. ..... 273/173; 273/DIG. 3; 273/169; 273/167 R

[58] Field of Search ..... 273/167–175, 273/77 R

[56] References Cited

U.S. PATENT DOCUMENTS

| | | | |
|---|---|---|---|
| 1,133,129 | 3/1915 | Govan | 273/171 |
| 1,378,416 | 5/1921 | Keys | 273/173 |
| 1,435,318 | 11/1922 | Mattern | 273/173 |
| 1,449,559 | 3/1923 | So Relle | 273/173 |
| 1,463,533 | 7/1923 | Kurz | 273/173 |
| 1,504,326 | 8/1924 | Cullinan | 273/169 |
| 1,504,380 | 8/1924 | Reitenour | 273/168 |
| 1,595,589 | 8/1926 | Tyler | 273/173 |
| 1,605,551 | 11/1926 | Mattern | 273/169 |
| 3,591,183 | 7/1971 | Ford | 273/167 R |
| 3,652,094 | 3/1972 | Glover | 273/171 |
| 4,199,632 | 4/1980 | Travis | 273/167 R X |

FOREIGN PATENT DOCUMENTS

| | | | |
|---|---|---|---|
| 440379 | 12/1935 | United Kingdom | 273/171 |

*Primary Examiner*—George J. Mario
*Assistant Examiner*—Sabastiano Passaniti
*Attorney, Agent, or Firm*—Wood, Herron & Evans

[57] ABSTRACT

A durable wooden golf club head is disclosed having a hitting face with a non-wooden durable insert that is screw threaded into the head whereby the wooden head and face are protected from deterioration upon impact by a golf ball. The wooden head is made by screw threading the insert into a matching socket and causing a hardenable liquid adhesive to hydraulically penetrate the head from the socket to the surface of the wood whereby the head provides a solid golf ball hitting body.

10 Claims, 2 Drawing Sheets

DURABLE WOODEN GOLF CLUB HEAD

BACKGROUND OF THE INVENTION

A golf club having a wooden head, more commonly known today as a "wooden driver" or "fairway wood", dates back to the origin of the game. The original wooden heads have been improved by seating or anchoring an insert or plate in the striking face of the wood. Different materials, such as ivory, fiber, ebony, hickory, plastic and metal have been inserted into the face of the club. Such inserts allow the transmission of greater force by the player to the ball at the point of impact to achieve greater driving distance. Examples of early patents that included inserts or face plates in the striking face of the club are U.S. Pat. Nos. 1,435,318 and 1,605,551. These patents disclose a wooden golf club head having a face plate with screw threaded studs for anchoring the face plate in the head. Other examples of inserts or face plates are disclosed in U.S. Pat. Nos. 1,449,559; 1,504,380; 1,504,326 and 3,652,094.

Most recently the golf industry has shifted emphasis to drivers having metal heads for a number of reasons including driving accuracy and distance, and due to the hard covered ball that is being used. The more durable polymeric cover on golf balls, e.g., "Surlyn", causes the hitting face of the wooden golf club to deteriorate. The wooden striking face is eroded upon impact with such hard covered balls. Accordingly, more golfers are using the metal headed driver even though they would prefer the look, feel and tradition of the wooden driver.

SUMMARY OF THE INVENTION

This invention is directed to a wooden golf club head suitable for use with drivers and fairway golf clubs. This new wooden head fulfills a need in the golf industry.

In one embodiment of this invention, a wooden club head body is provided with a non-wooden durable screw threaded cylindrical insert in the hitting face to protect it against deterioration. In this embodiment, a cylindrical socket formed entirely by the wood of the head body extends from the surface of the wooden hitting face into the body of wood behind the face. The socket has a counter-bored screw threaded portion for securely receiving the insert. The insert has a threaded end and head portion to match the socket for securement therein with the insert head having an exposed surface flush with the hitting face whereby the golf head and face are protected against deterioration upon impact by a golf ball. The wooden hitting face of the club is made durable by the use of a non-wooden durable insert of fiber, metal or plastic. The insert is introduced into the face by a unique method that solidifies the insert and wooden head into one unitary mass. This invention has been found to provide an extremely solid hitting face that is durable and yet gives the look of wood.

In one preferred form, the wooden golf club head comprises a wooden hitting face having toe, central face plate and heel face areas. In the toe or heel face area of the wooden head there is inserted the non-wooden durable screw threaded generally cylindrical insert. The insert has one end that is screw threaded and an unthreaded head portion for insertion into a counter-bored socket formed entirely by the wood of the head extending from the face surface into the body and usually arranged with the grain direction of the line of stroke. The insert is screw threaded into the wooden hitting face followed by finishing the unthreaded portion off to make it flush with the face. Prior to the introduction of the threaded insert into the counter-bored socket, a substantial amount of hardenable liquid adhesive is placed into the socket such that, when the insert is screwed into place, the pressure exerted causes the adhesive to permeate through the fibers of the wood from the socket to the exterior surface of the head. Thus, the insert in the toe or heel face area is completely embedded and directly surrounded by the wood throughout its entire depth in the wood. The liquid adhesive is hydraulically forced through the fibers of the wood behind the face and throughout the volume of the head to provide a solid golf ball hitting face attributable to the co-action of the insert bonded into the wooden head and the adhesive extending through the entire volume of the wood. The golf club head with the durable face insert thus protects the hitting face of the wood from deterioration upon impact with hard covered golf balls.

In its most preferred form, both the toe and heel face areas of the wooden club are protected by the durable insert, although some golfers may prefer the insert in only one of these areas depending upon their hitting tendencies. Thus, if either the toe or heel area of the wood is contacted by the golf ball, the wood is protected from damage. Furthermore, even such toe or heel hits provide a solid feel. More solid hits are obtained by the golfer attributable to the solid bonding of the non-wooden durable insert in the wooden head. This is due to the unitary mass of the wood, as it is solidified by the hardened adhesive substantially throughout the head volume, coupled with the bonded threaded insert.

In another of its aspects, this invention provides for a new method of making a wooden golf club head. According to this method, a durable non-wooden screw threaded generally cylindrical face insert is screw threaded into a counter-bored socket in the wood. The insert has an enlarged head portion that is finished to be flush with the face. Prior to insertion, substantial amount of hardenable liquid adhesive is deposited into the socket not only to serve as a means for bonding the insert into the socket but to hydraulically permeate the fibers of the wood through the volume of the head to its exterior surface. In practicing the method of this invention, it has been found that when an effective amount of adhesive is used, it is forced hydraulically through the fibers of wooden head under pressure to exit at various locations on the surface of the wooden head. In its broadest form of the method, the socket need not be entirely formed by the wood of the body, provided that the adhesive is able to penetrate from the socket through the body under pressure to the surface of the head. Preferably, the socket is entirely formed by the surrounding wood and the adhesive can penetrate in all directions. It is considered very surprising that the screw threaded insert according to the method of this invention will cause such adhesive to penetrate throughout the head of the club for hardening or curing thereby providing the unitary securement of the insert in the head and a solid feel to the golfer upon impact with the ball.

The benefits and advantages of this invention will be further understood with reference to the drawings and detailed description which follows hereinafter.

DETAILED DESCRIPTION OF THE INVENTION

Figure 1:
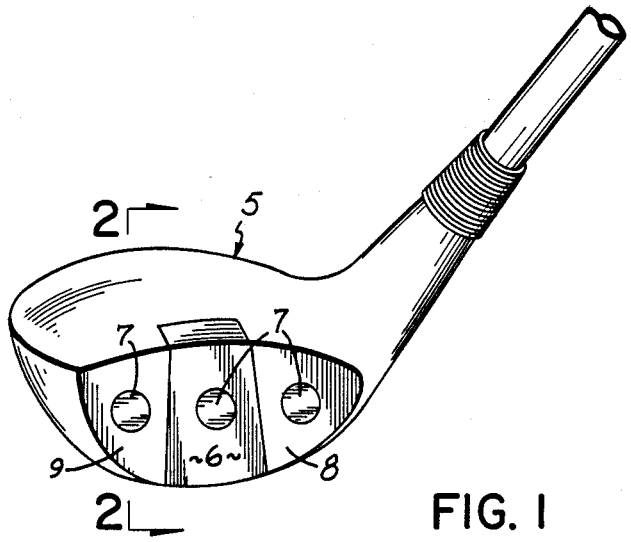
FIG. 1 is a perspective view of a golf club wooden head illustrating one embodiment of the invention.

Referring to the drawings, in FIG. 1 there is shown the head of a golf club 5 made out of wood having a face plate 6 and durable inserts 7 according to this invention in the heel 8 and toe 9 areas on both sides of the face plate 6. The central face plate 6 is inlaid in the striking face of the golf club and the face plate 6 may be made of plastic, metal or other suitable material. The inserts 7 in the heel 8 and toe 9 areas of the face are completely embedded and directly surrounded by wood as illustrating the construction of the driver according to the principles of this invention. Such a construction has been found to protect the wood against impact damage and provide the solid feel or hit.

Figure 2A:
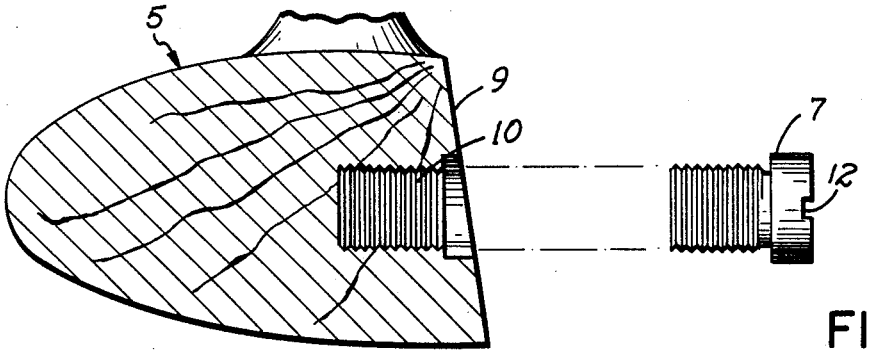
FIG. 2A is a cross-sectional view of the golf club head of FIG. 1 through a counter-bored socket provided in the head prior to insertion of the durable face insert.
Figure 2B:
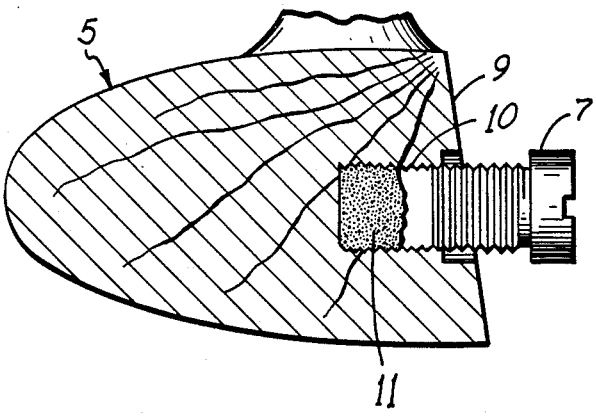
FIG. 2B is a similar view of the cross-section of FIG. 2 illustrating the introduction of the cylindrical face insert and also showing the substantial amount of glue that has been introduced into the socket.
Figure 2C:
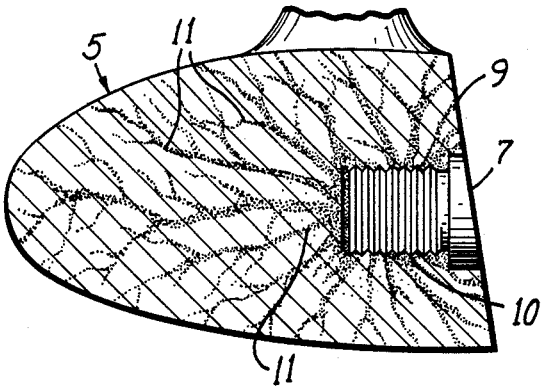
FIG. 2C is an illustration of the insert completely screwed into place and finished; and diagrammatically illustrating the hydraulic penetration of the glue or adhesive into and through the volume of the golf club head behind the hitting face to the exterior surface of the head.

The unique wooden head construction and method of making it are best illustrate with reference to FIGS. 2A–2C. A wooden golf club head is generally fabricated with a notch (not shown) for a central face plate 6 extending from the bottom to the top of the wooden face. During fabrication at least one counter-bored socket 10 for insert 7 is formed in the wood as shown in FIG. 2A in the heel 8 or toe 9 area. The counter-bored socket 10 is usually arranged with the wood grain in the direction of the line of the stroke so that the impact is received on the ends of the grain. Counter-bored socket 10 is shown in FIG. 2A as such would appear in the toe 9 or heel 8 face area of the head 5. FIG. 2B illustrates the introduction of the hardenable liquid adhesive or glue 11 into the cavity of the counter-bored socket 10 prior to the introduction of the non-wooden durable screw threaded cylindrical face insert 7. The particular construction of the insert 7 and the material of which it is made are known and illustrated by U.S. Pat. Nos. 1,435,318 and 1,605,551 for instance. It is understood that these inserts are made of durable fiber, hard rubber, plastic, metal or metal alloys. It is to be understood that the exact material is not an essential aspect of this invention. Heretofore, as exemplified by these patents, such inserts were used to anchor the central face plate. In contrast, according to this invention, such inserts are embedded into the wood and directly surrounded by the wood to protect the wood and hitting face from deterioration. As shown in FIG. 2A, the insert 7 is screw threaded throughout the greater portion of its length, leaving adjacent the exterior a substantial unthreaded portion that has a slot 12 in it for use with a screw driver that enables the insert 7 to be screw threaded into the counter-bored socket 10 after deposition of the adhesive into the socket. As the insert is screw threaded by means of a screw driver into the tightly fitting counter-bored socket, the glue 11 that substantially fills the socket penetrates the fibers of the wood hydraulically and seeks the natural cavities of the wood. It has been found that adhesives will follow weaknesses or fibers in the wood and actually ooze out of the exposed surfaces of the wood as the glue 11 follows such lines of weakness substantially throughout the volume of the head 5 as diagrammatically shown in FIG. 2C. The head of the insert 7 is finished flush with the hitting face area as shown in FIG. 2C. With the introduction of the plural inserts 7 as shown in FIG. 1, the glue thus penetrates throughout the volume of the head providing a rigid unitary structure across its entire depth attributable to the coaction of the inserts glued into the head in the toe, central and heel hitting areas and wherein the glue solidifies the fibers of the wood throughout the head. As shown in FIG. 1, there is an insert 7 that also secures face plate 6 in the central hitting area of the face; and, thus, it will be understood that this insert is screw threaded into the head in the same fashion as that shown in FIGS. 2A–C, except that it is inserted through a hole in face plate 6. Thus, the inserts 7 in the heel 8 and toe 9 areas protect the hitting face of the wooden head 5 against deterioration upon impact with a golf ball and provide the golfer with a unitary solid hitting face.

In fabricating the wooden heads, it has been found that resorcinol-formaldehyde resin or epoxyamine hardenable liquid adhesives are preferred. In particular Koppers Company makes a resorcinolformaldehyde resin adhesive under the trademark PENACOLITE. This resorcinol-formaldehyde resin is a two component adhesive system in which resorcinolformaldehyde resin is cured or hardened with a 37% formaldehyde aqueous solution of methanol. It's also been found that epoxy resins with amine hardeners are suitable as adhesives for use in this invention as exemplified by Magnobond adhesives made by Magnolia Plastics, Inc. which are well known epichlorohydrinaliphatic amine curing agent systems. It has been found either of these types of adhesives allow hydraulic penetration into the fibers of the wood throughout the head by screw threading the cylindrical insert into a tightly fitting socket where the socket was previously filled substantially or fully with the glue. Of course, the specific adhesive is not an essential element of the invention and others can be used.

From the above description it will be apparent that a new golf club head has been provided and a new method of fabricating wooden golf club heads has been achieved. Interlocking of the insert with the head by means of the screw thread and glue penetrated throughout the volume of the head, and across its depth, provides a firm and unitary striking head in order to achieve greater distances upon striking a golf ball. Furthermore, the entire face of the wooden head can now be made resistant to the more durable synthetic or polymeric golf ball covers. The unitary feel or solid hit that is experienced by a golfer using the wooden head of this invention provides a new dimension of satisfaction.

From the above description it will also be apparent that the invention should not be limited to the specific details or materials, and the means of construction may be varied to achieve its benefits. Thus, modifications may be made by a person of ordinary skill in the art in view of the above description without departing from the scope of this invention.

What is claimed is:

1. A wooden golf club head comprising a body of wood having a wooden hitting face with toe, central and heel face hitting areas, at least one generally cylindrical socket formed entirely by the wood of said body extending from the surface of the wooden hitting face in any of said hitting areas into said body of wood behind said face, said socket having a counter-bored screw threaded portion for securely receiving an insert, and a non-wooden durable generally cylindrical insert having a screw threaded end and head portion to match said socket in screw threaded securement therein, said insert head portion having an exposed surface flush with said hitting face, said insert adhesively bonded into said wood by a hardenable liquid adhesive penetrating the wood behind the face through the volume of the wooden head from the socket to the exterior surface of the wood whereby said head provides a solid golf ball hitting body attributable to the coaction of the insert bonded into said head and for protection of the wooden face against deterioration upon impact by a golf ball.

2. The golf club head of claim 1 wherein said central face hitting area is provided with a face plate secured into the wooden hitting face from the bottom to the top of the face and where said insert is secured into a socket in the toe face hitting area.

3. The golf club head of claim 1 wherein said central face hitting area is provided with a face plate secured into the wooden hitting face from the bottom to the top of the face and where said insert is secured into a socket in the heel face hitting area.

4. The golf club head of claim 1 wherein said central face hitting area is provided with a face plate secured into the wooden hitting face from the bottom to the top of the face and where said insert is secured into sockets in both the toe and heel face hitting areas.

5. The golf club head of claim 1 wherein said central face hitting area is provided with a face plate from the bottom to the top of the face secured by means of a screw threaded insert into the wooden hitting face and where said insert is secured into sockets in both the toe and heel face hitting areas.

6. The golf club head of claim 1 wherein said insert is made of fiber, plastic or metal.

7. A method of making a wooden golf club head comprising providing a wooden golf club head having a wooden hitting face, counter-boring a screw threaded generally cylindrical socket through said wooden face into the head, introducing hardenable liquid adhesive into said socket to at least partially fill the socket in an amount for penetration through the volume of the head from the socket to the exterior surface of the wooden head, screw threading a non-wooden durable screw threaded generally cylindrical insert into said socket, said insert matching said socket, forcing said liquid adhesive by screw threading said insert to cause penetration of adhesive behind the face through the volume of the wooden head from the socket to the exterior surface of the wooden head whereby said adhesive upon solidification provides a solid golf ball hitting head attributable to the coaction of the insert so bonded into the head and the wooden face is protected against deterioration upon impact with a golf ball.

8. The method of claim 7 wherein said glue is selected from the group consisting of resorcinolformaldehyde resin and epoxy resin.

9. The method of claim 7 wherein a plurality of counter-bored sockets are provided in the hitting face with said insert glued into each.

10. The method of claim 7 further comprising providing a central face plate in said face from the top to the bottom of said face and said socket is counter-bored into the head on either side of said plate.

* * * * *